US010948209B2

(12) United States Patent
Song et al.

(10) Patent No.: US 10,948,209 B2
(45) Date of Patent: Mar. 16, 2021

(54) MONITORING SYSTEM FOR RESIDENTIAL HVAC SYSTEMS

(71) Applicant: The Board of Regents of the University of Oklahoma, Norman, OK (US)

(72) Inventors: Li Song, Norman, OK (US); Choon Yik Tang, Norman, OK (US)

(73) Assignee: The Board of Regents of the University of Oklahoma, Norman, OK (US)

( * ) Notice: Subject to any disclaimer, the term of this patent is extended or adjusted under 35 U.S.C. 154(b) by 10 days.

(21) Appl. No.: 16/263,642

(22) Filed: Jan. 31, 2019

(65) Prior Publication Data

US 2019/0234638 A1 Aug. 1, 2019

Related U.S. Application Data

(60) Provisional application No. 62/625,089, filed on Feb. 1, 2018.

(51) Int. Cl.
*F24F 11/00* (2018.01)
*F24F 11/46* (2018.01)
(Continued)

(52) U.S. Cl.
CPC ..... *F24F 11/46* (2018.01); *F24F 11/38* (2018.01); *F24F 11/64* (2018.01); *F24F 11/65* (2018.01);
(Continued)

(58) Field of Classification Search
CPC .. F24F 11/38; F24F 11/46; F24F 11/64; F24F 11/65
See application file for complete search history.

(56) References Cited

U.S. PATENT DOCUMENTS 10,443,873 B1 * 10/2019 Johnson ..... F24F 11/62
2015/0127165 A1 * 5/2015 Quam ..... G06Q 10/0639 700/275

(Continued)

OTHER PUBLICATIONS

Wang, et al.; "Describe Home Thermal Dynamics Using a Second-Order Home Thermal Model and Real-Time Parameter Estimation,"; School of Aerospace and Mechanical Engineering; Apr. 15, 2017; 21 pages.

*Primary Examiner* — Mark A Connolly
(74) *Attorney, Agent, or Firm* — Dunlap Codding, P.C.

(57) ABSTRACT

A system and method for controlling HVAC equipment in a residential setting. The system may include an outdoor temperature sensor positioned to measure outdoor temperatures, an indoor air temperature sensor to measure indoor space air temperatures, a supply duct air temperature sensor positioned to measure supply duct air temperatures, a return duct air temperature sensor positioned to measure return duct air temperatures, an air blower current sensor positioned to measure air blower currents, and/or an air compressor current sensor positioned to measure air compressor currents, and a controller operable to receive the measures of outdoor temperature, indoor space air temperature, supply duct air temperature, return duct air temperature, air blower current, air compressor current, and measures of solar irradiation intensity and wind speed. The controller may be programmed with instructions to input the measures into a thermal model for outputting signals for implementing changes in the system.

20 Claims, 11 Drawing Sheets

(51) Int. Cl.

| | |
|---|---|
| ***F24F 11/38*** | (2018.01) |
| ***F24F 11/64*** | (2018.01) |
| ***F24F 11/65*** | (2018.01) |
| *F24F 110/12* | (2018.01) |
| *F24F 130/20* | (2018.01) |
| *F24F 140/60* | (2018.01) |

(52) U.S. Cl.
CPC ... *F24F 2011/0002* (2013.01); *F24F 2110/12* (2018.01); *F24F 2130/20* (2018.01); *F24F 2140/60* (2018.01); *F24F 2221/18* (2013.01)

(56) References Cited

U.S. PATENT DOCUMENTS

2018/0313557 A1* 11/2018 Turney ..... F24F 11/64
2020/0132327 A1* 4/2020 Samuni ..... G05B 15/02

* cited by examiner

Parameter Estimation Scheme: Methodology

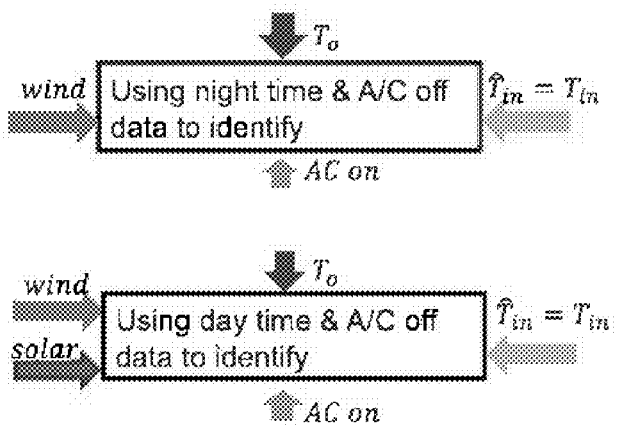

Step 1: Identify $\tau_1, c_1, c_2, b_1, b_2$

(1) $\frac{dT_1(t)}{dt} = -\frac{1}{\tau_1}T_1(t) + \frac{1}{\tau_1}[c_1 T_o(t)]$ (2) $T_2(t) = c_2 T_o(t) + \big(T_o(t) - T(t)\big)\big(b_1 w(t) + b_2 w^2(t)\big)$ (5) $T(t) = T_1(t) + T_2(t)$

Step 2: Identify $\tau_3, a_0, a_1, a_2, a_3$

(3) $\frac{dT_3(t)}{dt} = -\frac{1}{\tau_3}T_3(t) + \frac{1}{\tau_3}[a_0 + a_1 s(t) + a_2 s^2(t) + a_3 s^3(t)]$ (5) $T(t) = T_1(t) + T_2(t) + T_3(t)$

Step 3: Identify $\tau_4, Q$

(4) $\frac{dT_4(t)}{dt} = -\frac{1}{\tau_4}T_4(t) + \frac{1}{\tau_4}[Qu(t)]$ (5) $T(t) = T_1(t) + T_2(t) + T_3(t) + + T_4(t)$

FIG. 4

| Date | 12/4 | 12/5 | 12/6 | 12/7 | 12/8 | 12/9 |
|---|---|---|---|---|---|---|
| Measured Heater on Time | 192 | 202 | 369 | 469 | 521 | 378 |
| Predicted Heater on Time | 194 | 227 | 382 | 445 | 453 | 295 |
| Absolute Difference | 2 | 25 | 13 | 24 | 68 | 83 |
| Predictive Percent of Total Heating on Time | 99.0% | 87.6% | 96.5% | 94.9% | 86.9% | 78.0% |
| Date | 12/10 | 12/11 | 12/12 | 12/13 | 12/14 | 12/15 |
| Measured Heater on Time | 169 | 319 | 328 | 471 | 543 | 303 |
| Predicted Heater on Time | 126 | 257 | 339 | 387 | 486 | 242 |
| Absolute Difference | 43 | 62 | 11 | 30 | 57 | 61 |
| Predictive Correctness of Total Heating on Time | 74.6% | 80.6% | 96.7% | 92.8% | 89.5% | 79.9% |

FIG. 11

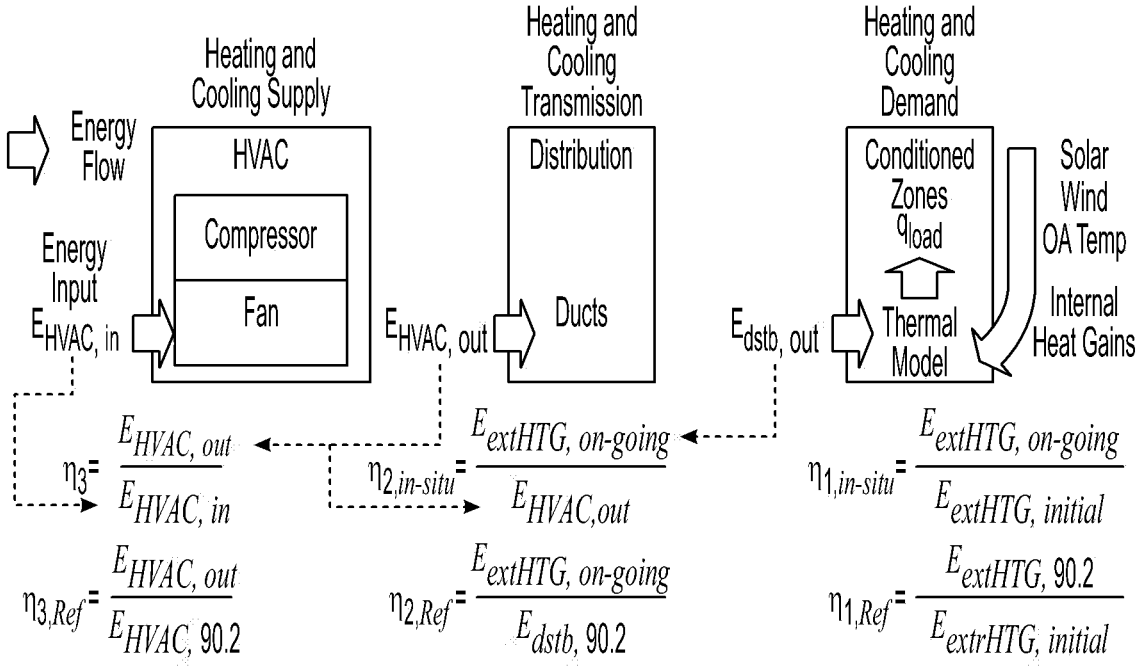

Where $E_{extHTG, on\text{-}going} = \Sigma Qu(t)$ Positive for extracted heat and negative for added heat wher

FIG. 12

MONITORING SYSTEM FOR RESIDENTIAL HVAC SYSTEMS

INCORPORATION BY REFERENCE OF RELATED APPLICATIONS

The present patent application claims priority to the provisional patent application U.S. Ser. No. 62/625,089, filed on Feb. 1, 2018, the entire contents of which is expressly incorporated herein by reference.

BACKGROUND

To date, significant efforts have been devoted to the development of fault detection and automatic commissioning technologies for roof-top and built-up units in buildings. However, such technologies are primarily intended for commercial buildings, rather than for residential homes. Home heating, ventilation, and air conditioning (HVAC) operation costs are based on many factors (e.g., see FIGS. 1 and 2). For residential homes, the National Institute of Standards and Technology (NIST) has been developing adaptive fault detection and diagnosis techniques for air conditioners and heat pumps since 2014, but the work is still ongoing. Commercially available products in this market include smart thermostats sold by Nest™, Trane™, Honeywell™, Ecobee™, and Acculink™ Although each of these has its own unique features, these thermostats share a common attribute, in that all of them are remotely accessible through the Internet. These thermostats, however, do not possess a number of important capabilities to enhance performance, save energy, and reduce certain costs. It is to addressing these deficiencies that the novel embodiments of the present disclosure are directed.

BRIEF DESCRIPTION OF THE DRAWINGS

Several embodiments of the present disclosure are hereby illustrated in the appended drawings. It is to be noted however, that the appended drawings only illustrate several embodiments and are therefore not intended to be considered limiting of the scope of the present disclosure.

FIG. 4 shows a methodology for determining parameter estimates.

FIG. 11 shows the results of heating output predictions over the 12-day test period based on 24-hour ahead predictions.

FIG. 12 is a schematic showing a total system monitoring approach to HVAC control.

DETAILED DESCRIPTION

Figure 1:
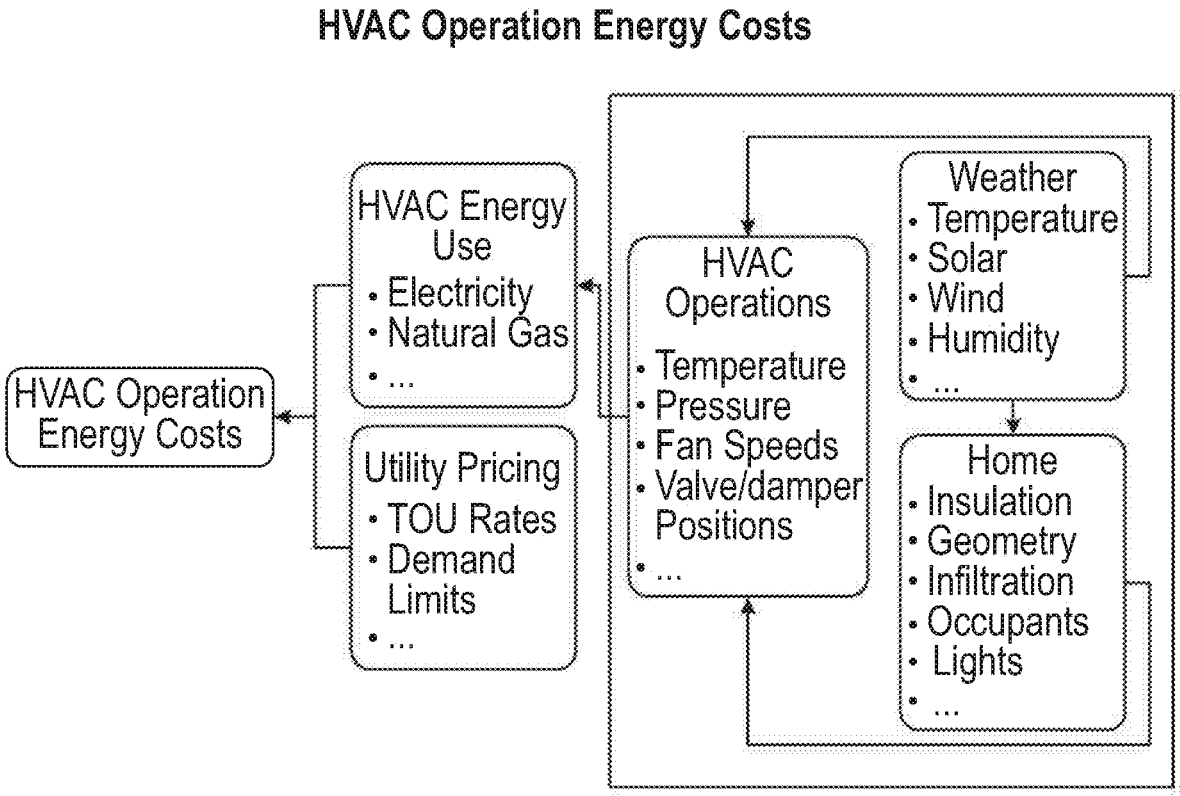
FIG. 1 is a schematic showing typical factors that contribute to HVAC energy and operations costs.
Figure 2:
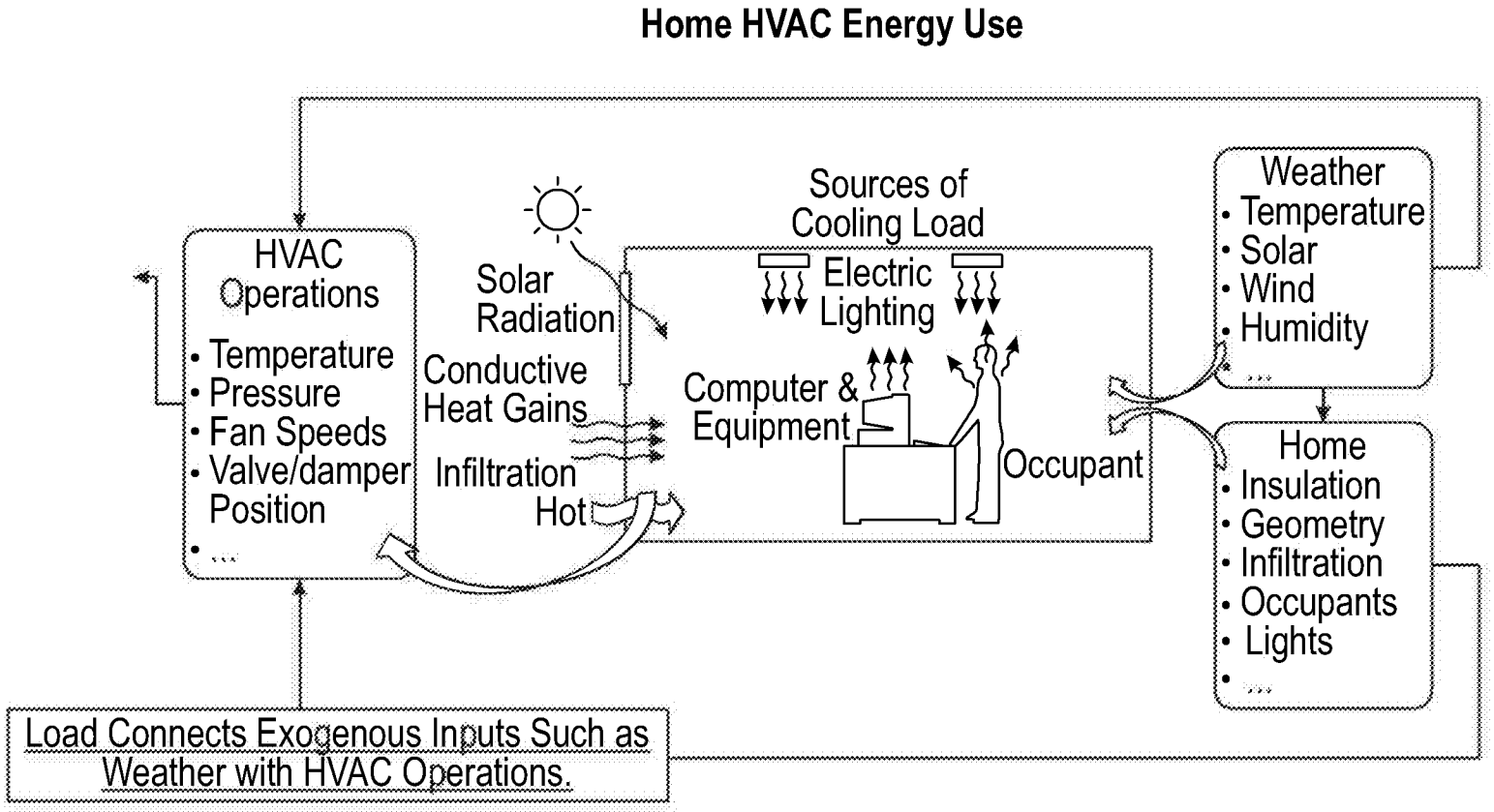
FIG. 2 is a schematic showing how home thermal load connects home HVAC energy use with exogenous inputs such as weather.

Currently available residential HVAC monitoring systems have a number of shortcomings. Disclosed herein in various embodiments are systems and methods for addressing such deficiencies by utilizing sensors, models, algorithms, and weather forecasts to, for example, monitor the performance of HVAC components in residential homes, provide alerts (e.g., to homeowners) of service needs, faults, and energy usages, and enable such users to make informed, optimal, cost-saving decisions about their residential systems. For example, such monitoring can detect and enable alerts of system faults in real-time, provide alerts of service needs and energy usages based on true performance (e.g., filter replacement alerts based on filter clogginess, rather than based on preset time schedules, and the ability of the user to make informed, optimal, cost-saving decisions by considering multiple "what-if" scenarios with different temperature setpoints.

By offering such capabilities and others that conventional products lack, the presently disclosed systems and methods fill a substantial gap between what users (e.g., homeowners, home service contractor, home builders and smart thermostat manufacturers) desire and what has been available previously. In at least certain embodiments, these capabilities are enabled by several innovative features within the system, including for example, (1) a plurality of judiciously placed, wirelessly connected, low-cost temperature and current sensors, (2) a scientifically justified, home thermal model based on the principles of heat transfer and theory of dynamical systems, (3) a novel performance monitoring and fault detection algorithm that exploits the characteristics of HVAC components and building materials, and (4) a predictive algorithm based on the mentioned home thermal model for providing a future estimate of temperature and energy-cost, for example of the next day. Such innovative features of the presently disclosed "smart system" can be used to reduce the energy costs of a residential HVAC system.

Heating and cooling costs represent a large expense for homeowners and renters. According to the DOE's Buildings Energy Data Book, the average annual utility expense per household is $2500 to $3000, of which 54% is used for space heating and cooling. Thus, an HVAC monitoring system such as described herein, which helped reduce energy needs for space heating and cooling by 10%, would result in savings of $135 to $162 per year. At a cost-per-unit of, for example, $300 per unit, the payback period for the unit would be approximately two years.

Before describing various embodiments of the embodiments of the present disclosure in more detail by way of exemplary description, examples, and results, it is to be understood that the embodiments of the present disclosure are not limited in application to the details of methods and apparatus as set forth in the following description. The embodiments of the present disclosure are capable of other embodiments or of being practiced or carried out in various ways. As such, the language used herein is intended to be given the broadest possible scope and meaning; and the embodiments are meant to be exemplary, not exhaustive. Also, it is to be understood that the phraseology and terminology employed herein is for the purpose of description and should not be regarded as limiting unless otherwise indicated as so. Moreover, in the following detailed description, numerous specific details are set forth in order to provide a more thorough understanding of the disclosure. However, it will be apparent to a person having ordinary skill in the art that certain embodiments of the present disclosure can be practiced without these specific details. In other instances, features which are well known to persons of ordinary skill in the art have not been described in detail to avoid unnecessary complication of the description.

Unless otherwise defined herein, scientific and technical terms used in connection with the embodiments of the present disclosure shall have the meanings that are commonly understood by those having ordinary skill in the art. Further, unless otherwise required by context, singular terms shall include pluralities and plural terms shall include the singular.

All patents, published patent applications, and non-patent publications mentioned in the specification are indicative of the level of skill of those skilled in the art to which embodiments of the present disclosure pertain. All patents, published patent applications, and non-patent publications referenced in any portion of this application are herein expressly incorporated by reference in their entirety to the same extent as if each individual patent or publication was specifically and individually indicated to be incorporated by reference.

While the methods and apparatus of the embodiments of the present disclosure have been described in terms of particular embodiments, it will be apparent to those of skill in the art that variations may be applied to the thereto and in the steps or in the sequence of steps of the methods described herein without departing from the spirit and scope of the inventive concepts. All such similar substitutes and modifications apparent to those of skilled in the art are deemed to be within the spirit and scope of the systems as defined herein.

As utilized in accordance with the methods and apparatus of the embodiments of the present disclosure, the following terms, unless otherwise indicated, shall be understood to have the following meanings:

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or when the alternatives are mutually exclusive, although the disclosure supports a definition that refers to only alternatives and "and/or." The use of the term "at least one" will be understood to include one as well as any quantity more than one, including but not limited to, 2, 3, 4, 5, 6, 7, 8, 9, 10, 15, 20, 30, 40, 50, 100, or any integer inclusive therein. The term "at least one" may extend up to 100 or 1000 or more, depending on the term to which it is attached; in addition, the quantities of 100/1000 are not to be considered limiting, as higher limits may also produce satisfactory results. In addition, the use of the term "at least one of X, Y and Z" will be understood to include X alone, Y alone, and Z alone, as well as any combination of X, Y and Z.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAABCCCC, CBBAAA, CABABB, and so forth. The skilled artisan will understand that typically there is no limit on the number of items or terms in any combination, unless otherwise apparent from the context.

Throughout this application, the term "about" or "approximately" is used to indicate that a value includes the inherent variation of error. Further, in this detailed description, each numerical value (e.g., time or frequency) should be read once as modified by the term "about" (unless already expressly so modified), and then read again as not so modified unless otherwise indicated in context. The use of the term "about" or "approximately" may mean a range including ±1%, or ±5%, or ±10%, or ±15%, or ±25% of the subsequent number unless otherwise stated.

As used herein, the term "substantially" means that the subsequently described event or circumstance completely occurs or that the subsequently described event or circumstance occurs to a great extent or degree. For example, the term "substantially" means that the subsequently described event or circumstance occurs at least 90% of the time, or at least 95% of the time, or at least 98% of the time.

Features of any of the embodiments described herein may be combined with any of the other embodiments to create a new embodiment. As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Also, any range listed or described herein is intended to include, implicitly or explicitly, any number within the range, particularly all integers, including the end points, and is to be considered as having been so stated. For example, "a range from 1 to 10" is to be read as indicating each possible number, particularly integers, along the continuum between about 1 and about 10. Thus, even if specific data points within the range, or even no data points within the range, are explicitly identified or specifically referred to, it is to be understood that any data points within the range are to be considered to have been specified, and that the inventors possessed knowledge of the entire range and the points within the range. Thus, to illustrate, reference to a numerical range, such as 1-10 includes 1, 2, 3, 4, 5, 6, 7, 8, 9, 10, as well as 1.1, 1.2, 1.3, 1.4, 1.5, etc., and so forth. Reference to a range of 1-50 therefore includes 1, 2, 3, 4, 5, 6, 7, 8, 9, 10, 11, 12, 13, 14, 15, 16, 17, 18, 19, 20, etc., up to and including 50, as well as 1.1, 1.2, 1.3, 1.4, 1.5, etc., 2.1, 2.2, 2.3, 2.4, 2.5, etc., and so forth. Reference to a series of ranges includes ranges which combine the values of the boundaries of different ranges within the series. Thus, to illustrate reference to a series of ranges, for example, of 1-10, 10-20, 20-30, 30-40, 40-50, 50-60, 60-75, 75-100, 100-150, 150-

200, 200-250, 250-300, 300-400, 400-500, 500-750, 750-1,000, includes ranges of 1-20, 10-50, 50-100, 100-500, and 500-1,000, for example.

As noted above, the present disclosure describes in at least one non-limiting embodiment, a smart performance monitoring and energy-cost prediction system 10 (See FIG. 6) and method (referred to hereafter as the system) for heating, ventilation and air conditioning (HVAC) components installed in a residential unit 12 such as a house, apartment, or condominium. The system 10 is made up of the following six main entities, including (1) wireless sensors 14, (2) a controller 16, (3) a home thermal (HT) model, (4) a performance monitoring and fault detection (PMFD) algorithm, (5) a temperature and energy-cost prediction (TECP) algorithm, and (6) an optimal space temperature control algorithm. These entities together provide the system 10 with the following three main capabilities: (1) real-time performance monitoring and fault detection; (2) alerts on actual service needs and energy usages; and (3) aid in helping the user make informed, optimal, cost-saving decisions. Other embodiments of the system 10 may comprise fewer than all five of these features.

Entities of the System

Controller

The controller 16 includes circuitry configured to receive data signals (e.g., wirelessly) from the sensors 14, and is programmed with the home thermal model, the performance monitoring and fault detection algorithm, the temperature and energy-cost prediction algorithm, and the optimal space temperature control algorithm. The circuitry of the controller 16 analyzes data signals to create the home thermal model, and also analyzes the data signals with the home thermal model and the performance monitoring and fault detection algorithm, the temperature and energy-cost prediction algorithm, and the optimal space temperature control algorithm to generate real-time information. Thereafter, the circuitry of the controller 16 issues signals to a device to change a thermostat setting, and/or alert a user of the system to at least one of a service need, a system fault, and a projected energy usage of the system 10. The circuitry of the controller 16 includes a transceiver 16*a*. The transceiver 16*a* receives data indicative of the thermostat setting, and/or the alert, and communicates the thermostat setting to a controller of the HVAC system, and/or the alert to a user device. In one embodiment, the transceiver 16*a* conforms to the requirements of IEEE 802.11. For example, the transceiver 16*a* may conform to the requirements of any one of IEEE 802.11 a, b, g, n, ac, ad, af, ah, ai, aj, aq, ax, or ay, for example. The transceiver 16*a* may also interface and communicate with a local area network, the Internet, and/or the Ethernet to obtain data from third party sources, such as weather data. For example, the transceiver 16*a* may also conform to the requirements of 802.2.

Circuitry, as used herein, may be analog and/or digital components, or one or more suitably programmed processors (e.g., microprocessors) and associated hardware and software, or hardwired logic. Also, "components" may perform one or more functions. The term "component" may include hardware, such as a processor (e.g., microprocessor), and application specific integrated circuit (ASIC), field programmable gate array (FPGA), a combination of hardware and software, and/or the like. The term "processor" as used herein means a single processor or multiple processors working independently or together to collectively perform a task.

Software may include one or more computer readable instructions that when executed by one or more components cause the component to perform a specified function. It should be understood that the computer readable instructions of the algorithms described herein may be stored on one or more non-transitory memory. Exemplary non-transitory memory may include random access memory, read only memory, flash memory, and/or the like. Such non-transitory memory may be electrically based, optically based, and/or the like.

Wireless Sensors

Figure 6:
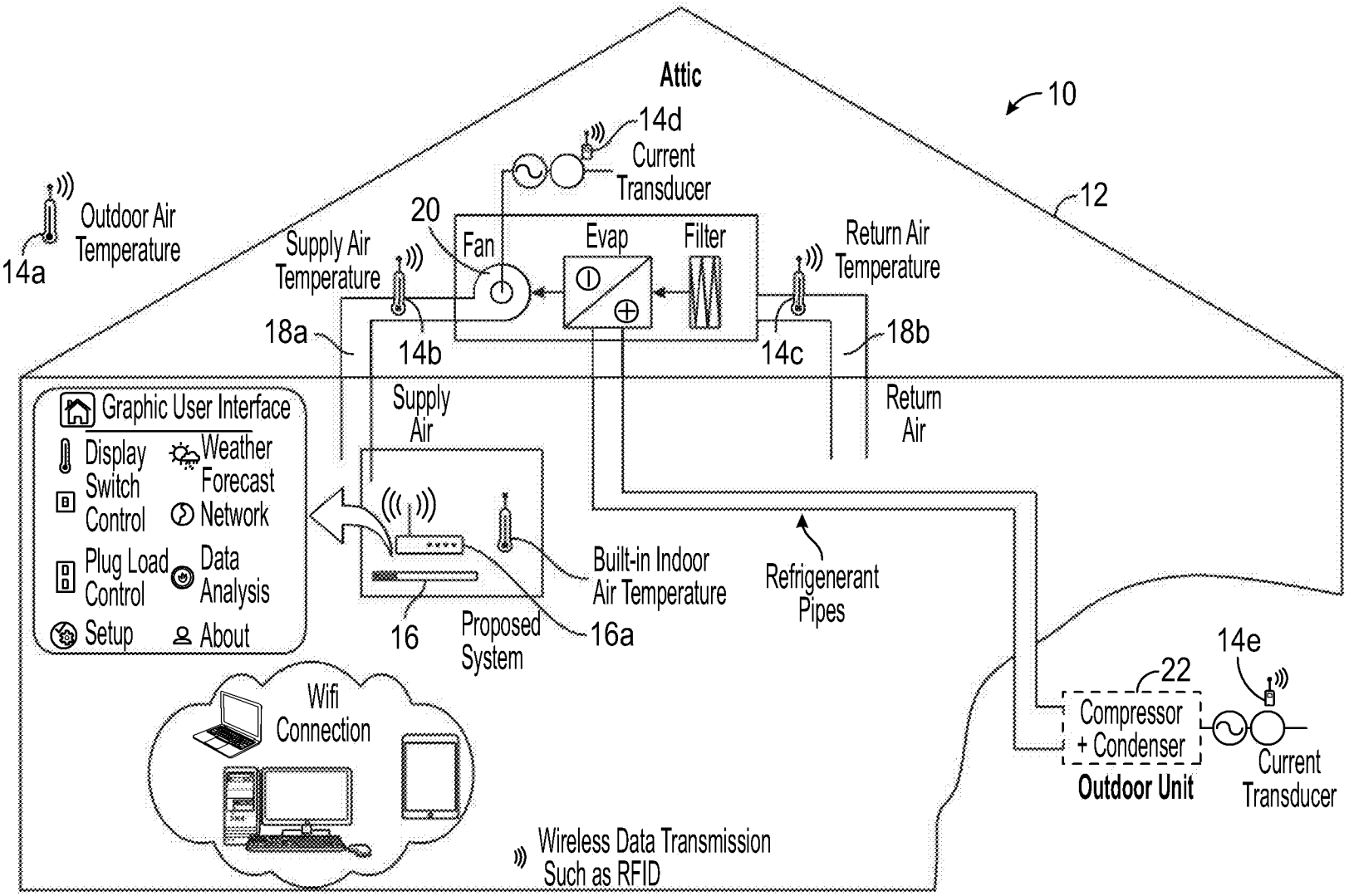
FIG. 6 is a schematic showing a hardware configuration of an exemplary system in accordance with the present disclosure.

The system 10 contains a set of judiciously placed, wirelessly connected, temperature and current sensors 14. In one embodiment, the temperature and current sensors 14 are low cost. As shown in FIG. 6, in a typical scenario, three temperature sensors 14*a*, 14*b*, and 14*c* are installed, one outdoors, one inside an air supply duct 18*a*, and one inside an return air duct 18*b*. Two current sensors 14*d* and 14*e* are installed, one on an air blower 20 and one on a compressor 22, which are usually served by different electrical circuits for homes. These sensors 14*a-e* are used to continuously log the runtime of the HVAC components and collect data that are necessary for training the home thermal model and calculating the real-time HVAC system efficiency. The air blower 20 can be a single-phase fan motor. The compressor 22 can be an A/C compressor. For a single-phase fan motor and an A/C compressor, the current data can also be used to calculate power usage. For a constant air volume system which is what most home HVAC systems include, the supply and return air temperature data can also be used to calculate cooling and heating outputs. For a variable air volume system, which is relatively rare in homes, virtual airflow sensors (for example as disclosed in U.S. Provisional Application Ser. No. 615,754, filed on Jan. 10, 2018) can be adopted.

Home Thermal (HT) Model

The system 10 contains a scientifically justified, home thermal model based on the principles of heat transfer and theory of dynamical systems. The home thermal model is developed based on a simplified thermal network approach. In system-theoretic terms, the model is a nonlinear, time-invariant dynamical system with indoor air temperature as one of its two states, and with outdoor air temperature, solar irradiation intensity, wind speed, and HVAC system on/off as its inputs. In addition, the model is characterized by a set of parameters, including time constants and several polynomial coefficients that describe how solar intensity and wind speed affect the states. Solar irradiation intensity and wind speed inputs may be obtained for example from a local weather station. At a specific time instant (e.g., 8:00 PM) on each day, these in-situ parameters are identified or trained, e.g., using the least-squares method, and the data is collected by the sensors 14*a-e* over a specific number of days (e.g., 10 days) prior to the time instant. This parameter identification process is fully automated, requiring no intervention from homeowners.

The HT model, in at least one non-limiting embodiment, comprises the following 5 equations:

$$\frac{dT_1(t)}{dt} = -\frac{1}{\tau_1}T_1(t) + \frac{1}{\tau_1}[c_1 T_o(t)] \quad \text{(Eq. 1)}$$

$$T_2(t) = c_2 T_o(t) + (T_o(t) - T(t))(b_1 w(t) + b_2 w^2(t)) \quad \text{(Eq. 2)}$$

$$\frac{dT_3(t)}{dt} = -\frac{1}{\tau_3}T_3(t) + \frac{1}{\tau_3}[a_0 + a_1 s(t) + a_2 s^2(t) + a_3 s^3(t)] \quad \text{(Eq. 3)}$$

-continued $$\frac{dT_4(t)}{dt} = -\frac{1}{\tau_4}T_4(t) + \frac{1}{\tau_4}[d_0 + Qu(t)] \quad \text{(Eq. 4)}$$

$$T(t) = T_1(t) + T_2(t) + T_3(t) + T_4(t) \quad \text{(Eq. 5)}$$

where:

$T_0$ (t) is the outdoor air temperature at time t;

$T_1$ (t) is the indoor air temperature influenced by the outdoor air only;

$T_2$ (t) is the indoor air temperature influenced by wind and outdoor air temperature;

$c_1$, $c_2$ are weighting factors of the outdoor air temperature impacts;

$b_1 b_2$ are regression coefficients of the wind impacts;

w(t) is wind speed at time t;

s(t) is solar irradiation intensity at time t;

$T_3$ (t) is the indoor air temperature influenced by the solar;

$a_0$, $a_1$, $a_2$, $a_3$ are regression coefficients of solar;

$T_4$ (t) is the indoor air temperature influenced by the internal heat gains and HVAC system;

$d_0$ is the internal heat gain;

Q is a regression coefficient of the HVAC heating and cooling output;

u(t) is the HVAC system on/off status; and $\tau_1$, $\tau_3$, $\tau_4$ are time constants.

Figure 3:
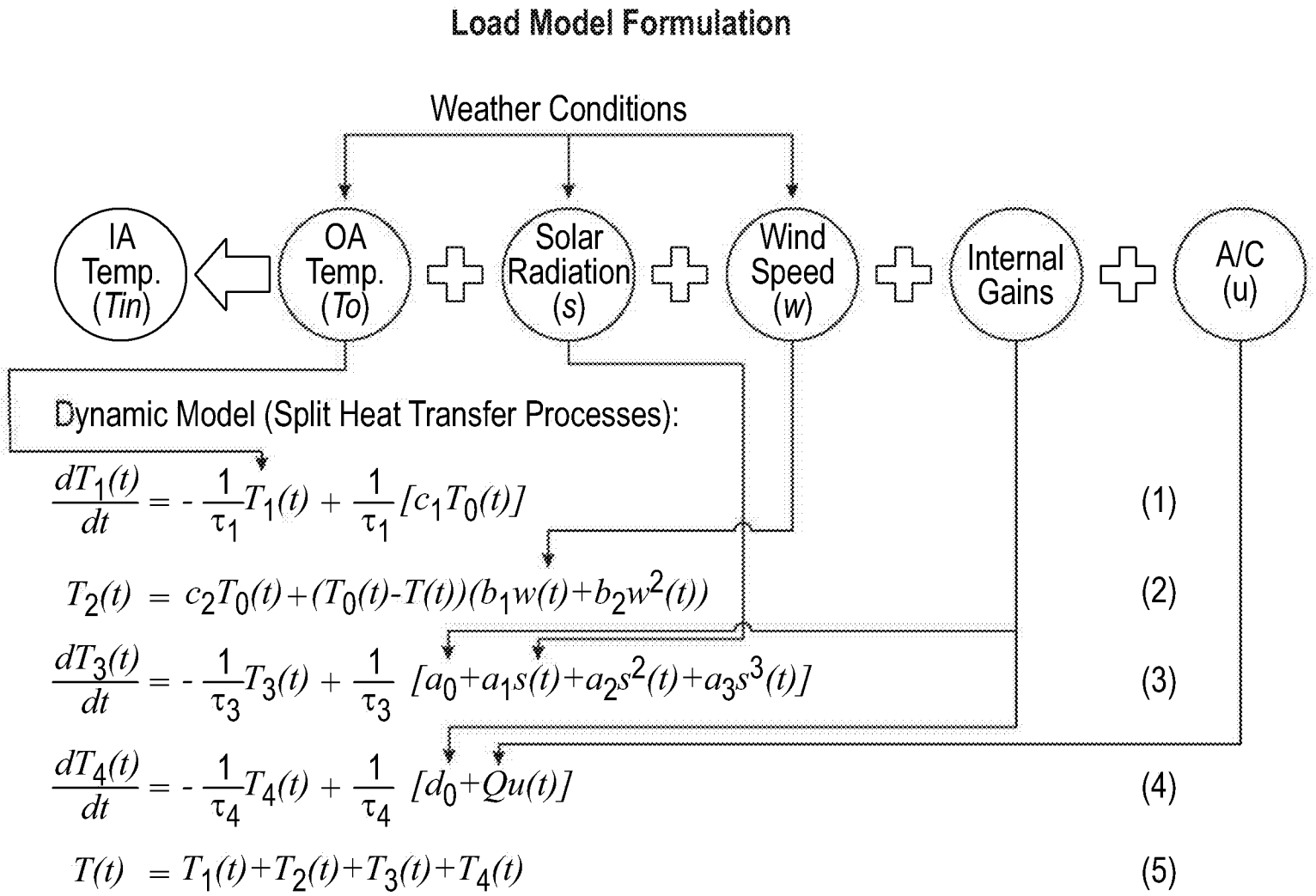
FIG. 3 shows the equations of the Home Thermal (HT) model of the present disclosure.
Figure 5:
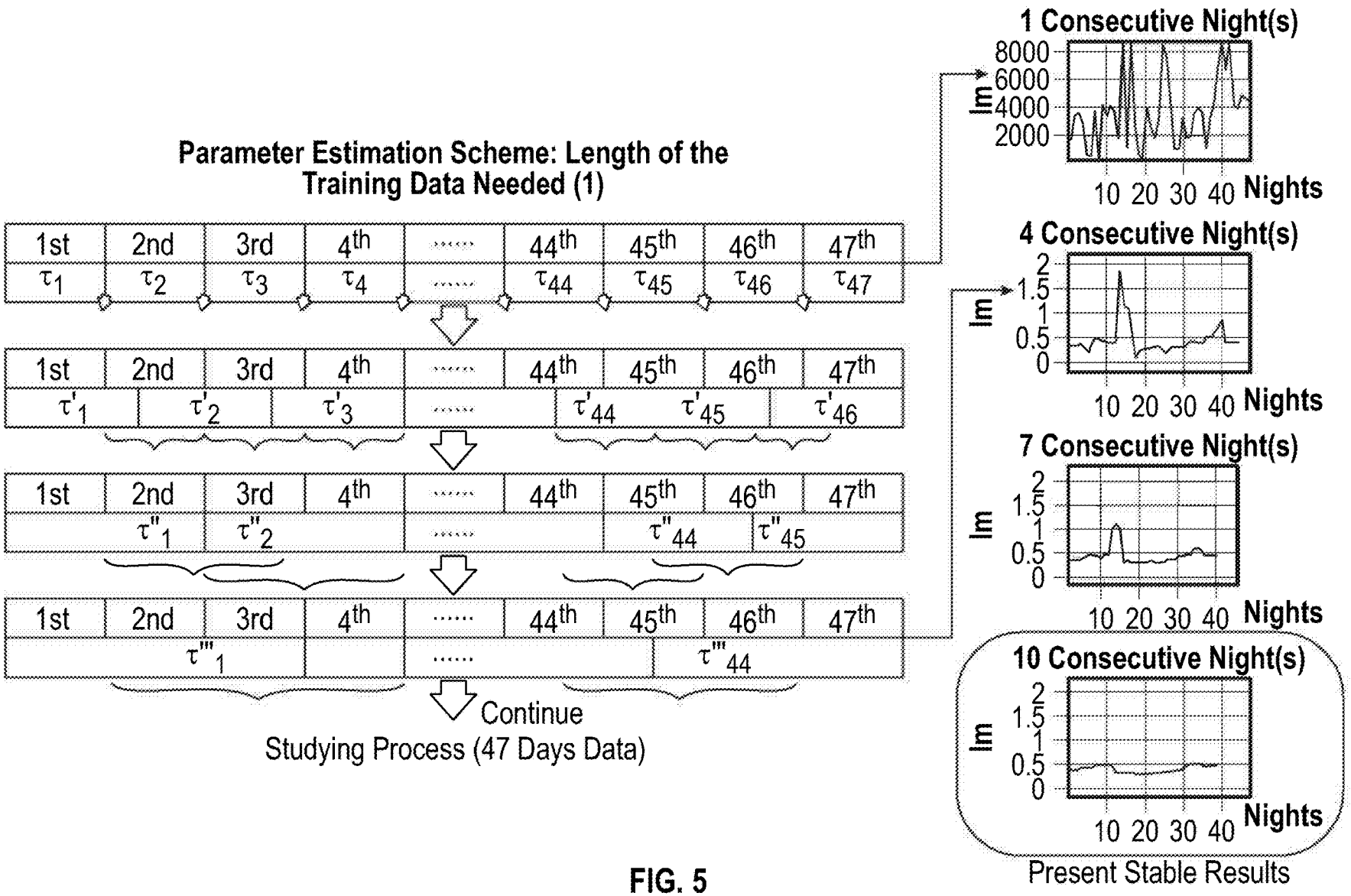
FIG. 5 shows a parameter estimating scheme for determining the necessary length of training data.

FIG. 3 shows how various parameters and coefficients of the model correspond to particular weather conditions and features of HVAC systems. FIGS. 4 and 5 show how the various parameters and coefficients of the HT model are obtained through a parameter identification scheme.

In at least one embodiment, parameter identification of the home thermal model comprising Eq. 1 to Eq. 5 is obtained stepwise by beginning with solving Eq. 1 and Eq. 4. For example, the uncertainties from solar and wind measurements tend to introduce the most errors, and the accuracy of $\tau_1$ and $\tau_4$, in Eq. 1 and Eq. 4 are the most dominant parameters for ensuring the accurate representative of the home thermal properties. Therefore, the parameter identification scheme first applies the night time data, when there is no solar and wind speed is so low to be negligible, to Eq. 1 when HVAC is off and to Eq. 4 when HVAC is on to identify $\tau_1$, $\tau_4$ and U, for example by using the Least Square method. Then, with the identified $\tau_1$, $\tau_4$, and U values, which possess the high accuracies without the errors introduced by wind and solar, the parameter identification scheme applies the nighttime data with higher wind speed to Eq. 2 to identify $c_1$, $a_1$ and $a_2$. Then, the parameter identification scheme applies daytime data to Eq. 3 to identify solar related parameters. The parameters identified by the solution of Eq. 1 to Eq. 4 are then used to solve Eq. 5, which provides the ultimate output of the home thermal model.

Performance Monitoring and Fault Detection (PMFD) Algorithm

The system 10 contains a novel performance monitoring and fault detection algorithm that exploits the characteristics of the HVAC components and building materials. By comparing the logged runtime of the HVAC components with the runtime predicted by the HT model using a desired efficiency, the algorithm is able to calculate the real-time HVAC system efficiency, monitor its degradation over time, and detect possible occurrences of faults. Moreover, by comparing the measured indoor air temperature float (when HVAC is off) with the indoor air temperature float predicted by the home thermal model, the algorithm is able to detect possible losses of home envelope integrity and quantify the losses in terms of costs. Furthermore, by using the available data, the algorithm is able to detect the following four types of faults: (F1) degradation in performance of the individual HVAC components, which is associated with decrease in efficiency and/or capacity caused by, for example, refrigerant leaks, changes in airflow rates, non-condensibles in the refrigerant, worn bearings in motors and compressors, etc.; (F2) HVAC operational faults, such as but not limited to, a fan that runs 24/7 without cycling off and not using a thermostat setback; (F3) home operational faults such as, but not limited to, open windows and deterioration of insulation and air-tightness; and (F4) leakages in the air distribution ducts.

The PMFD algorithm is not intended to carry out a detailed diagnosis of the faults. Rather, it is intended to generate information (e.g., cost impact and severity of comfort losses) that helps the user decide whether and when to have the HVAC components serviced. The PMFD algorithm includes the fault detection and diagnosis for the envelopes, ducts and HVAC systems that are all the components associated with the home comfort systems. Operation of the PMFD algorithm occurs as below.

First, performance of the envelope insulation and airtightness is evaluated by two approaches:

a. At the initial phase of the system installation, with the same given weather conditions, the load (Load-1) calculated by the HT model using the self-learned parameters (as explained elsewhere herein) is compared with the load (Load-Ref) calculated by the HT model using the parameters recommended by the ASHRAE 90.2-2007 standard. This approach is to bench mark the home envelope at the initial phase of the system installation.

b. In the on-going system operation phase, under the same real-time weather conditions, the load (Load-1) calculated by the HT model using the initial learned parameters is compared with the one (Load-2) calculated by HT model using the parameters continuously learned in the operation. This approach is to detect the deterioration of the envelope since the initiation of the system.

Second, the leaks of air ducts are detected by the air duct efficiency, that is defined by the ratio of the cooling/heating (Load-2) delivered by air ducts over the cooling/heating (Load-3) provided to the air by the HVAC system. Load-2 is obtained in the envelope performance detection and the heating/cooling provided by the HVAC system is calculated using the temperature difference between the return air and supply air that are measured using the return air duct and supply air duct sensors 14*c* and 14*b*, multiplied by the total airflow rate that is usually a constant. For a variable air volume system, which is relatively rare in homes, virtual airflow sensors (for example as disclosed in U.S. Provisional Application Ser. No. 615,754) can be adopted. In the initial phase of the system installation, the calculated duct efficiency is compared with the recommended duct leak ratio recommended by ASHRAE 90.2 for bench mark purpose. In the ongoing phase, the efficiency is compared to the initial efficiency to detect the deterioration of the duct leaks over time.

Third, the energy performance of the HVAC system is detected by the HVAC efficiency, that is defined by the ratio of the cooling/heating (Load-3) delivered by the HVAC system over the power consumed by the HVAC system. The power consumed by the HVAC system is measured by the air blower current sensor 14*d* and the air compressor current sensor 14*e*, one for the indoor unit and the other one for the outdoor unit. Similarly, the HVAC efficiency is compared with recommended HVAC efficiency by ASHRAE 90.2 at the initial phases for bench mark purpose. In the ongoing system operation phase, the efficiency is compared with the initial efficiency to detect the deterioration of the HVAC system over time.

Temperature and Energy-Cost Prediction (TECP) Algorithm

In at least one non-limiting embodiment, the system 10 contains an experimentally verified, one-day-ahead temperature and energy-cost prediction algorithm built upon the home thermal model. The basis of the algorithm can be summarized as follows: by selecting a temperature setpoint and using the home thermal model described above, identified parameters, and weather forecast available via the Internet, the algorithm is able to predict the indoor air temperature, the runtime of the HVAC components, and their efficiencies over the next 24 hours. The latter two, along with the electricity price forecast, can then be used to predict the one-day-ahead energy cost. By repeating this process for different temperature setpoints representing different desired comfort levels, the corresponding one-day-ahead energy costs can subsequently be determined. This information (i.e., how one-day-ahead energy cost depends on desired comfort level) can be very valuable to a user. In addition, as will be shown below, the algorithm has been experimentally verified to be accurate.

To implement the TECP algorithm load-2 is calculated using the HT model, the local weather forecast, and the user's preferred thermal comfort level. Load-2 can be converted to the energy use by dividing the duct efficiency and HVAC efficiency defined by the PMFD algorithm. The energy use can be converted to the energy cost if the utility rate is known 24 hours ahead. Therefore, knowing the user's preferred comfort level, the cost of maintaining the preferred comfort level can be forecasted as long as the weather forecast and utility rate are available. In addition, the cost can be forecasted for multiple comfort choices (e.g., different space air temperatures). The availability of the energy costs for different comfort levels can help users make informed temperature setting decisions. This algorithm is particularly useful for a user who has signed up for the local Utilities' demand response program, which provides dynamic changing utility rate usually 24 hours in advance.

Capabilities of the System

Real-Time Performance Monitoring and Fault Detection (PMFD)

The system 10 is capable of monitoring the performance of the HVAC components and detecting a variety of common faults in real-time, including losses of home envelope integrity, degradation in performance of the individual HVAC components, HVAC operational faults, home operational faults, and leakages in the air distribution ducts. This capability is provided by the Performance Monitoring and Fault Detection (PMFD) Algorithm described above.

Alerts on Actual Service Needs and Energy Usages

The system 10 is capable of alerting the user (e.g., a home owner) of service needs and energy usages based on true performance, as opposed to preset time schedules. With this capability, when the performance of their A/C, heating, air distribution system and home insulation or air-tightness degrades, the user is alerted via, for example, display on a smart thermostat or user device, such as a cell phone, or notification on a tablet or home computer, as illustrated in FIG. 6. Depending on user preference, the alerts can also be directly sent to a home service contractor who will then approach the user and explain the potential risk of the faults and the benefits of the service need (e.g., a repair). Additional information can also be provided with the alerts, which helps the user decide whether and when to service their equipment. Such information optionally includes: increases in electricity expenditure caused by a performance degradation, extents of comfort losses, suggestions on actions to recover or improve performance (e.g., replace a filter), and recommendations to contact a professional service contractor when a fault is serious (e.g., check the refrigerant charge and evaporator air flow rate).

Helping Homeowners Make Informed, Optimal, Cost-Saving Decisions

The system 10 is capable of helping users make informed, optimal, cost-saving decisions by considering multiple "what-if" scenarios with different temperature setpoints representing different desired comfort levels. For example, in a case in which the Temperature and Energy-Cost Prediction (TECP) Algorithm is executed at a specific time instant (e.g., 8:00 PM) on each day, a table would be generated listing different temperature setpoints for the next 24 hours on one column, and the corresponding energy costs on a second column, thereby presenting multiple "what-if" scenarios. Based on these projections, a user could easily see the trade-off between a particular level of comfort and the associated costs, thereby enabling the user to make an informed decision for the next 24 hours as to the desired temperature for the duration of the time period. The data would also perhaps raise the awareness of the user toward their energy use, encouraging the user to turn their HVAC off or change their temperature setpoints when they are not home. Therefore, this capability can be very valuable and would be a desired feature of the system 10 disclosed herein. The TECP Algorithm could be modified to enable predictions for time periods shorter than 24 hours ahead (e.g., 12 hours ahead) or for time periods greater than 24 hours ahead (such as but not limited to, 36 hours, 48 hours, 60 hours, or 72 hours).

Experimental Results

The HT model and the TECP algorithm were experimentally tested using data collected in a test home over two months. The validation of the HT model was performed on an unoccupied 3,160 $ft^2$ house built in 2003. Data were collected between September 2016 to December 2016. Indoor air, outdoor air, and AC on/off signal were logged. A small weather station was set up to validate the wind and solar data downloaded from a local weather station. Parameters of the HT model were calculated as shown in Table 1.

TABLE 1

| Calculated HT Model parameters | |
|---|---|
| $\tau_1$ | 3227 |
| $\tau_3$ | 2725 |
| $\tau_4$ | 822.1 |
| $c_1$ | 0.9985 |
| $c_2$ | 0.001464 |
| $b_1$ | 0.01048 |
| $b_2$ | −0.00056 |
| $a_0$ | 145.4 |
| $a_1$ | −448.6 |
| $a_2$ | 651.7 |
| $a_3$ | −339.4 |
| Q | 46.93 |

Figure 7:
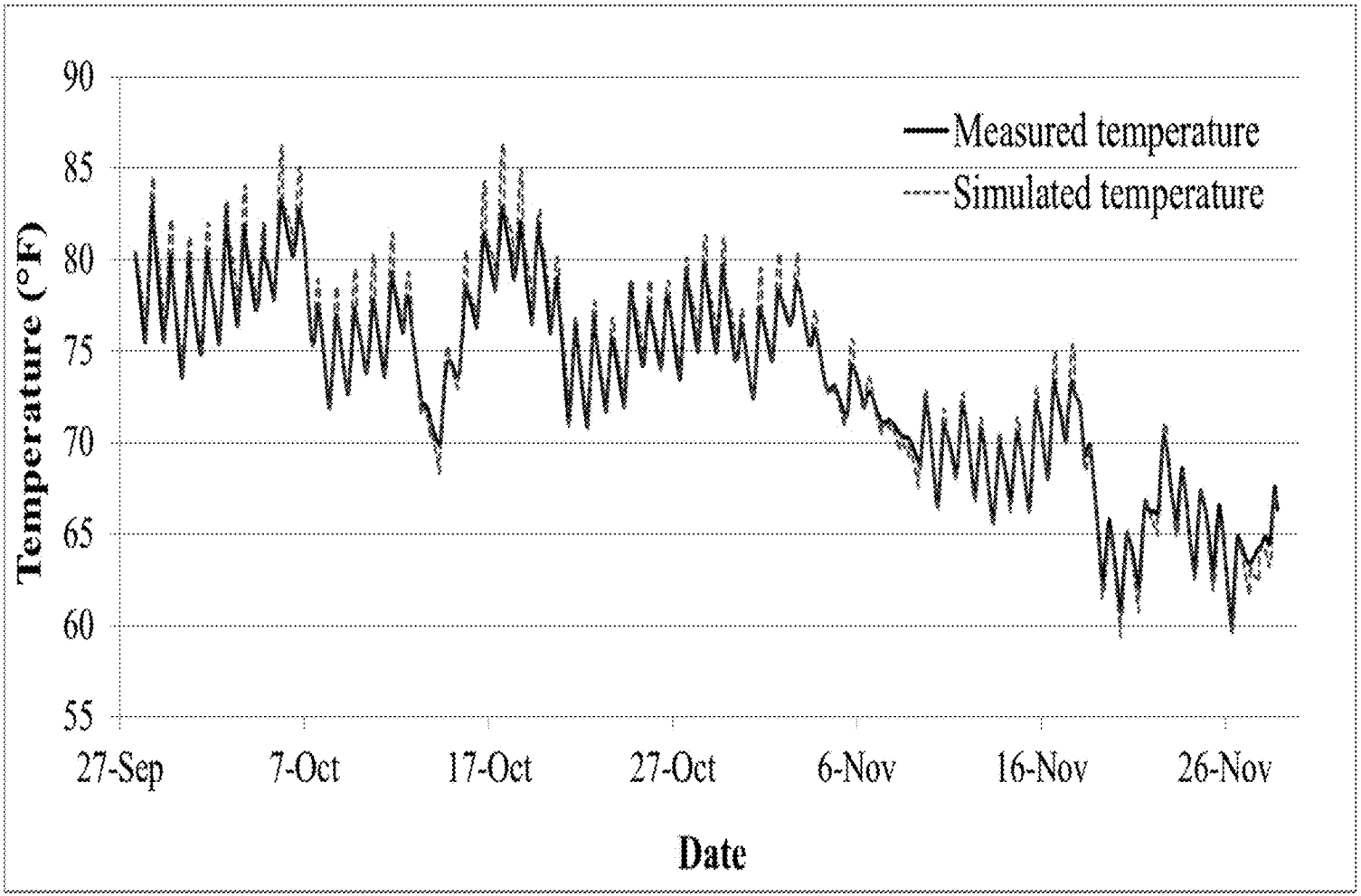
FIG. 7 shows a comparison between measured and simulated indoor air temperature in time series.
Figure 8:
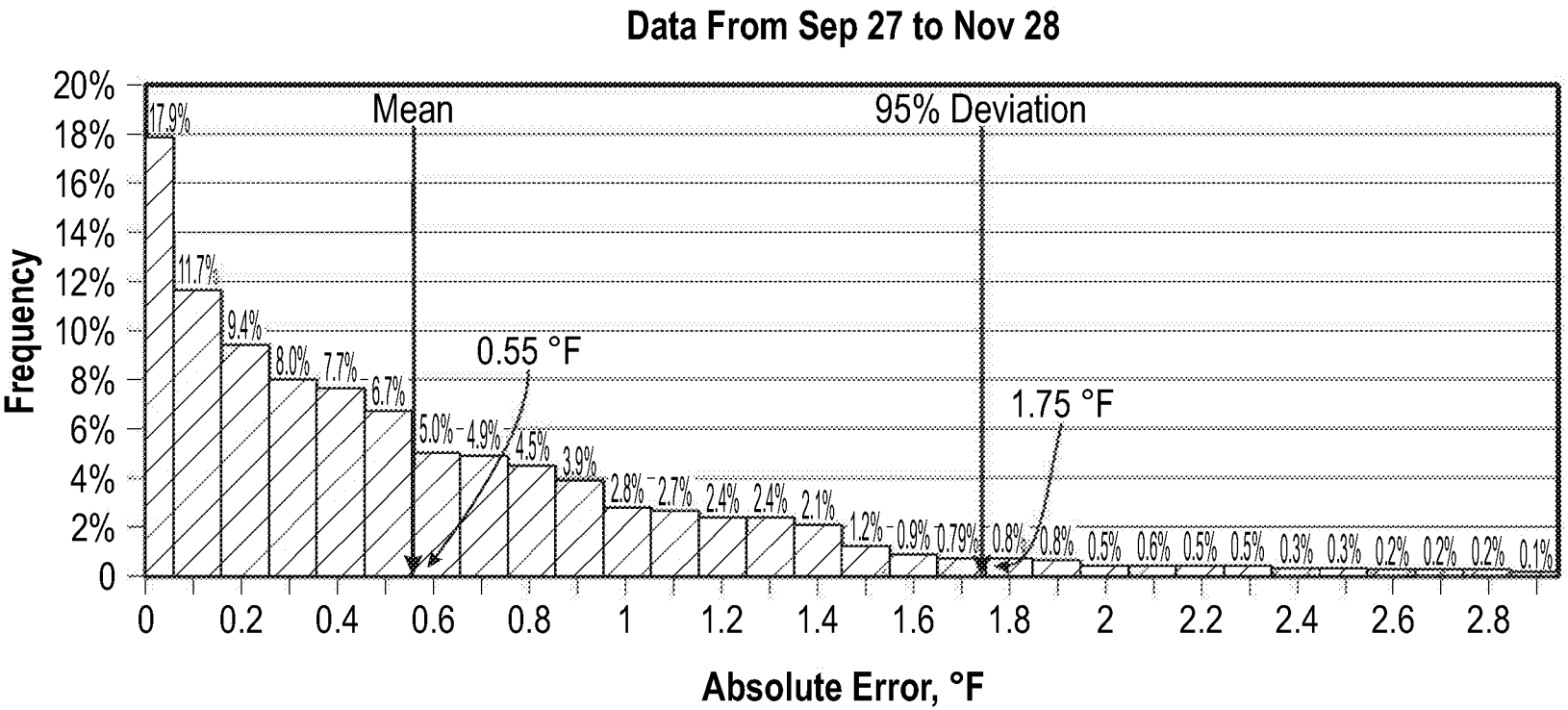
FIG. 8 is a graph showing absolute error probability of the simulated and measured temperature data.
Figure 9:
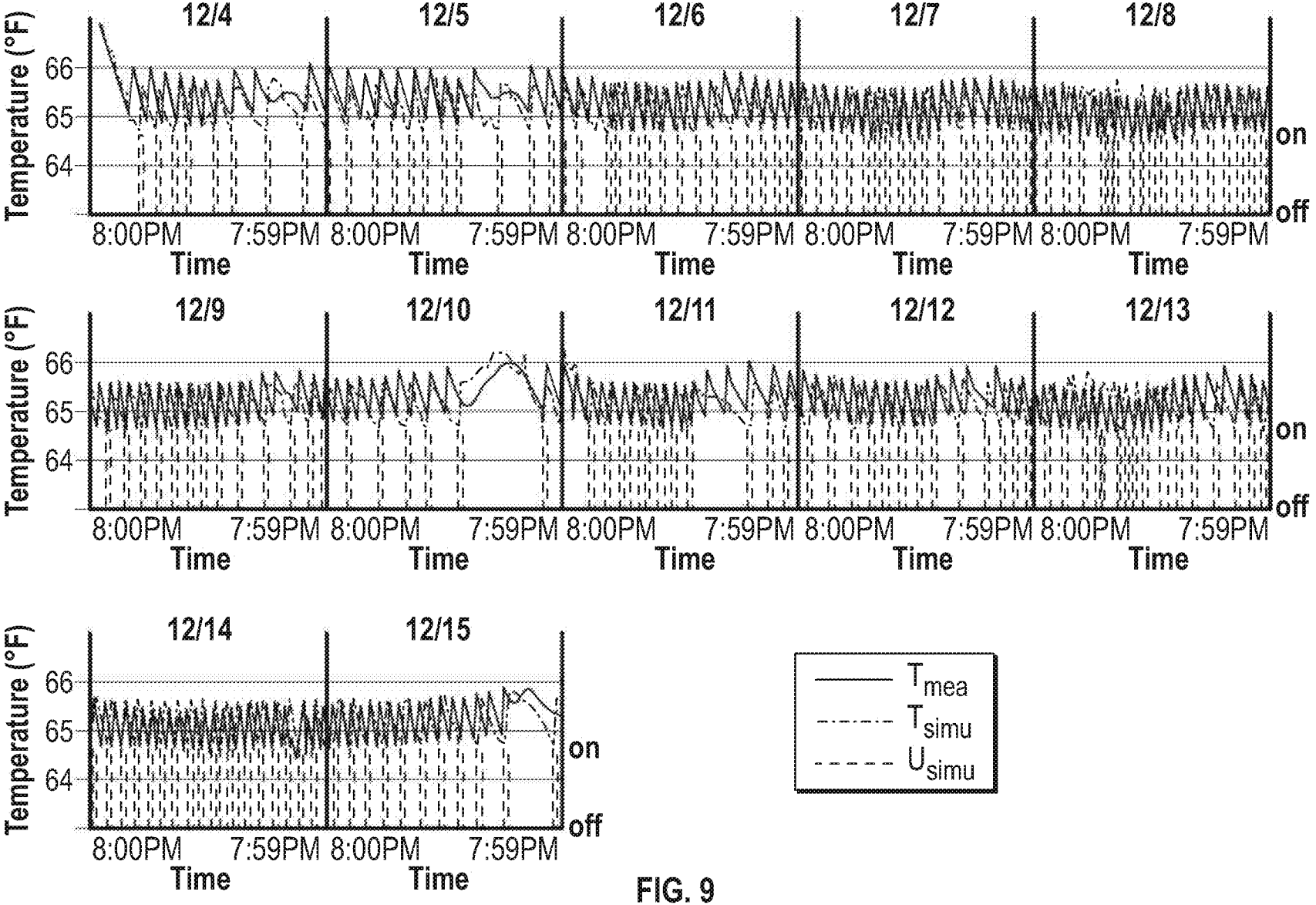
FIG. 9 shows results of predicted (24 hours ahead) vs. measured indoor temperatures (with heater on) taken during a 12-day period in December, 2016.
Figure 10:
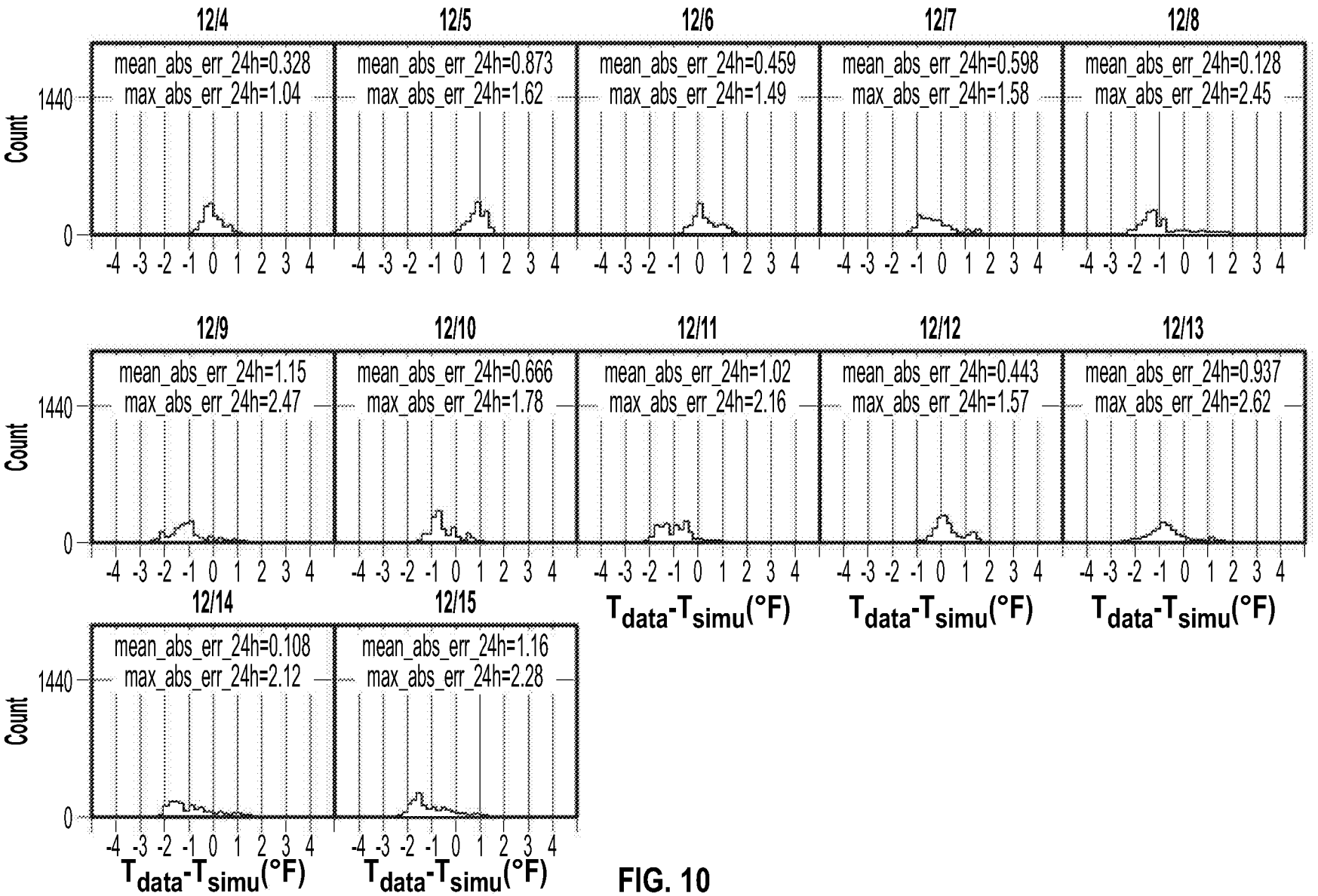
FIG. 10 shows error histograms of the indoor temperature forecasts taken during the 12-day period. Error distribution was mean and maximum of 24-hour ahead predictions.

FIG. 7 compares the measured and predicted indoor air temperatures over the two months, with the reference of the predicted indoor air temperature taken from a Nest white-paper published in 2015. 12-hour ahead indoor temperatures were predicted y minute intervals. FIG. 8 compares the resulting absolute error distribution with that from Nest. Note that Nest's prediction yields a narrow temperature band of 2.2° F., but also a large error that is capped at 1.8° F., which favors its prediction performance. In comparison, the prediction from the presently disclosed system 10 yields a mean absolute error of 0.55° F. over the entire two months, without having to cap the error. Also note that Nest's prediction assumes an HVAC optimal start before a home is occupied, whereas the presently disclosed system does not. FIG. 9 shows results of predicted (24 hours ahead) vs. measured indoor temperatures (with heater on) taken from Dec. 4, 2016 to Dec. 15, 2016. FIG. 10 shows error histograms of the indoor temperature forecasts taken from Dec. 4, 2016 to Dec. 15, 2016. Error distribution was mean and maximum of 24-hour ahead predictions. FIG. 11 shows the results of heating output predictions over the test period based on 24-hour ahead predictions.

In a preliminary version of the system 10 disclosed herein, to closely represent the temperature dynamics of a home, the home thermal dynamic responses to exogenous inputs, such as weather and internal load changes, were modeled (FIG. 12). A Resistance-Capacitance (R-C) model was used to capture the thermal dynamics over an extended prediction period. The R-C model is based on fundamental heat transfer and thermodynamics laws but is simplified by consolidating parameters and variables that are either costly or impossible to measure. Power use was inferred from two heating/cooling system electric current measurements and an assumed home voltage, and a space air temperature sensor.

Real-time code compliant and in-situ measured efficiencies for three components

As shown in FIG. 12, the disclosed algorithms monitor all three components in a home using six efficiencies. The six efficiencies include three code-compliant efficiencies and three in-situ measured efficiencies for the three components, including two heating and cooling system efficiencies ($\eta_{HVAC,R}$,$\eta_{HVAC,in\text{-}situ}$), two distribution system efficiencies ($\eta_{dstb,R}$,$\eta_{dstb,in\text{-}situ}$) and two home envelope thermal efficiencies ($\eta_{envelope,R}$,$\eta_{envelope,in\text{-}situ}$). The three code-compliant efficiencies complying with ASHRAE 90.2 (ASHRAE, Energy-Efficient Design of Low-Rise Residential Buildings, ANSI/ASHRAE Standard 90.2-2007) are used as performance benchmarks for the components at the time the system is installed. The "measured" in-situ efficiencies are compared to the corresponding code-compliant efficiencies to benchmark the initial home energy performance when the system is installed to detect design/construction deficiencies. The in-situ efficiencies are then compared either to these code-compliant benchmarks or to initial actual values of the in-situ efficiencies to detect performance degradation and faults in home operations and degradation of the thermal structural components, such as window seals, weather-stripping, and insulation in walls, which can settle, leaving gaps in the insulation.

The Home Envelope Efficiencies

Three calculated values of the heat extraction by the heating/cooling equipment (adding heat is negative extraction) are determined and applied to determine the envelope efficiencies: a reference value, a baseline value, and the current real-time value. The reference extracted heat is calculated using the thermal parameters of the home defined by compliance with ASHRAE 90.2; the baseline extracted heat is calculated using the initial thermal parameters of the home learned by the thermal model at the time when the system 10 is installed; the current, instantaneous, real-time value of extracted heat is calculated using the values of the thermal parameters continuously learned by the thermal model. The code-compliant efficiency is defined by the ratio of the baseline extracted heat to the reference extracted heat. The in-situ efficiency is defined as the ratio of the reference extracted heat to the instantaneous extraction heat.

The Distribution System Efficiency

The in-situ efficiency is defined as the ratio of the extracted heat, which corresponds to the heat removed/added (negative) by the distribution system to the indoor air, to the measured in-situ heating or cooling output at the heating and cooling system. The cooling or heating output is carried out by the supply air. The cooling and heating output can be easily obtained using supply air and return air temperatures for constant air volume systems which are the most prevalent for home heating/cooling. For a variable air volume system, which is currently rare in homes, the well-developed virtual airflow sensor technology (for example as disclosed in U.S. Provisional Application Ser. No. 615,754, filed on Jan. 10, 2018) can be applied. The code compliant efficiency is defined by the ratio of the same extraction heat over the calculated cooling and heating output using heat losses through duct insulation and leaks defined by ASHRAE 90.2.

The Heating and Cooling System Efficiency

The in-situ heating/cooling system efficiency is defined as the ratio of the cooling/heating equipment output to the distribution system to the input power to the heating and cooling systems. The input power can be precisely obtained using two electric current measurements, one for the indoor units (mainly an indoor supply fan and an electric heater, if applicable) and the other for the outdoor unit (both a compressor and a condenser fan). The code-compliant efficiency is defined as the ratio of the heating/cooling equipment output (same as used for the in-situ heating and cooling system efficiency calculation) to the HVAC input calculated using the equipment efficiencies defined by ASHRAE 90.2.

The in-situ efficiencies are compared to their respective code-compliant efficiencies to benchmark the current efficiencies of the three home components against code. Any discrepancies between the two efficiencies indicate a deficiency/fault. The real-time in-situ efficiencies are compared to their corresponding values at the time of system installation or last servicing or retrofit after system installation to detect the performance degradations/faults.

Both the thermal model and in-situ measured efficiencies are used in determining the optimal thermostat control for the heating/cooling system. The optimal thermostat control requires the minimization of the total heating and cooling costs over a 24-hour horizon. The heating and cooling costs are closely related to the indoor air temperature, which is influenced by current and past weather conditions, current and past internal loads, and the past effects of thermal storage in the home structure, and electricity rates, which dynamically change with time under some rate structures (e.g., between on- and off-peak hours within a 24-hour cycle). Within allowed space temperature floating ranges (comfortable conditions) specified by home occupants, the space temperature is determined for every point in time (e.g., hourly) by optimization based on projected total energy cost over 24 hours. The thermal model predicts indoor space temperature and heat extraction rates for the future hours, given forecasts of the driving conditions. The optimization feature is particularly valuable for the smart meter users who participate in utility demand response programs, enabling them to adjust thermostat settings schedules to take full advantage of variations in electricity rates, while satisfying comfort per their preferences.

While several embodiments have been provided in the present disclosure, it may be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, components, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and may be made without departing from the spirit and scope disclosed herein.

What is claimed is:

1. A system for controlling HVAC equipment in a residential setting, comprising:

an outdoor temperature sensor positioned to measure outdoor temperatures;

an indoor air temperature sensor to measure indoor space air temperatures;

a supply duct air temperature sensor positioned to measure supply duct air temperatures;

a return duct air temperature sensor positioned to measure return duct air temperatures;

an air blower current sensor positioned to measure air blower currents;

an air compressor current sensor positioned to measure air compressor currents; and a controller operable to receive the measures of outdoor temperature, indoor space air temperature, supply duct air temperature, return duct air temperature, air blower current, air compressor current, and measures of solar irradiation intensity and wind speed, wherein the controller comprises a component programmed with instructions to input the measures into a thermal model, identify parameter values of the thermal model, and implement the thermal model, after which implementation the controller issues signals to a device to change a thermostat setting, and/or alert a user of the system to at least one of a service need, a system fault, and a projected energy usage of the system.

2. The system of claim 1, wherein the parameter values of the thermal model are automatically identified using a self-learning parameter identification scheme which uses the measures taken over a short term of about 5 to 15 days.

3. The system of claim 1, wherein the thermal model comprises at least two equations selected from the group consisting of:

$$\frac{dT_1(t)}{dt} = -\frac{1}{\tau_1}T_1(t) + \frac{1}{\tau_1}[c_1 T_o(t)]; \quad \text{(Eq. 1)}$$

$$T_2(t) = c_2 T_o(t) + (T_o(t) - T(t))(b_1 w(t) + b_2 w^2(t)); \quad \text{(Eq. 2)}$$

-continued $$\frac{dT_3(t)}{dt} = -\frac{1}{\tau_3}T_3(t) + \frac{1}{\tau_3}[a_0 + a_1 s(t) + a_2 s^2(t) + a_3 s^3(t)]; \quad \text{(Eq. 3)}$$

$$\frac{dT_4(t)}{dt} = -\frac{1}{\tau_4}T_4(t) + \frac{1}{\tau_4}[d_0 + Qu(t)]; \text{ and} \quad \text{(Eq. 4)}$$

$$T(t) = T_1(t) + T_2(t) + T_3(t) + T_4(t). \quad \text{(Eq. 5)}$$

4. The system of claim 3, wherein the thermal model comprises Eq. 1 and Eq. 4, and wherein Eq. 1 is solved using measures obtained at night when the HVAC equipment is in an off-setting, and Eq. 4 is solved using measures obtained at night when the HVAC equipment is in an on setting.

5. The system of claim 4, wherein the thermal model further comprises Eq. 2, wherein Eq. 2 is solved using measures of wind speed.

6. The system of claim 5, wherein the thermal model further comprises Eq. 3, wherein Eq. 3 is solved using measures of solar irradiation.

7. The system of claim 6, wherein the thermal model further comprises Eq. 5, wherein Eq. 5 is solved using the parameters identified from Eq. 1 to Eq. 4.

8. The system of claim 1, wherein the controller component is programmed with instructions for performance monitoring and fault detection.

9. The system of claim 1, wherein the controller component is programmed with instructions for temperature and energy-cost prediction.

10. The system of claim 1, wherein the controller component programmed with instructions is a microprocessor.

11. A method of controlling HVAC equipment in a residential setting, comprising:

obtaining outdoor temperature measurements from an outdoor temperature sensor;

obtaining indoor space air temperature measurements from indoor air temperature sensor;

obtaining supply duct air temperature measurements from a supply duct air temperature sensor;

obtaining return duct air temperature measurements from a return duct air temperature sensor;

obtaining air blower current measurements from an air blower current sensor;

obtaining air compressor current measurements from an air compressor current sensor; and inputting the measurements of outdoor temperature, indoor space air temperature, supply duct air temperature, return duct air temperature, air blower current, air compressor current, and measurements of solar irradiation intensity and wind speed from an internet-accessible weather station into a controller comprising a component programmed with instructions to input the measurements into a thermal model, wherein parameter values of the thermal model are identified;

implementing the thermal model based on the identified parameter values; and outputting signals from the controller to a device to change a thermostat setting, and/or alert a user of the system to at least one of a service need, a system fault, and a projected energy usage of the system.

12. The method of claim 11, wherein the parameter values of the thermal model are automatically identified using a self-learning parameter identification scheme which uses the measurements taken over a short term of about 5 to 15 days.

13. The method of claim 11, wherein the thermal model comprises at least two equations selected from the group consisting of:

$$\frac{dT_1(t)}{dt} = -\frac{1}{\tau_1}T_1(t) + \frac{1}{\tau_1}[c_1 T_o(t)]; \quad \text{(Eq. 1)}$$

$$T_2(t) = c_2 T_o(t) + (T_o(t) - T(t))(b_1 w(t) + b_2 w^2(t)); \quad \text{(Eq. 2)}$$

$$\frac{dT_3(t)}{dt} = -\frac{1}{\tau_3}T_3(t) + \frac{1}{\tau_3}[a_0 + a_1 s(t) + a_2 s^2(t) + a_3 s^3(t)]; \quad \text{(Eq. 3)}$$

$$\frac{dT_4(t)}{dt} = -\frac{1}{\tau_4}T_4(t) + \frac{1}{\tau_4}[d_0 + Qu(t)]; \text{ and} \quad \text{(Eq. 4)}$$

$$T(t) = T_1(t) + T_2(t) + T_3(t) + T_4(t). \quad \text{(Eq. 5)}$$

14. The method of claim 13, wherein the thermal model comprises Eq. 1 and Eq. 4, and wherein Eq. 1 is solved using measurements obtained at night when the HVAC equipment is in an off setting, and Eq. 4 is solved using measurements obtained at night when the HVAC equipment is in an on setting.

15. The method of claim 14, wherein the thermal model further comprises Eq. 2, wherein Eq. 2 is solved using measurements of wind speed.

16. The method of claim 15, wherein the thermal model further comprises Eq. 3, wherein Eq. 3 is solved using measurements of solar irradiation.

17. The method of claim 16, wherein the thermal model further comprises Eq. 5, wherein Eq. 5 is solved using the parameters identified from Eq. 1 to Eq. 4.

18. The method of claim 11, wherein the controller component is programmed with instructions for performance monitoring and fault detection and the controller outputs a signal related to thereto.

19. The method of claim 11, wherein the controller component is programmed with instructions for temperature and energy-cost prediction and the controller outputs a signal related to thereto.

20. The method of claim 11, wherein the controller component programmed with instructions is a microprocessor.

* * * * *